US008207670B2

(12) United States Patent
Park et al.

(10) Patent No.: US 8,207,670 B2
(45) Date of Patent: Jun. 26, 2012

(54) PASTE COMPOSITION FOR FABRICATING ELECTRODE, ELECTRODE AND PLASMA DISPLAY PANEL FORMED USING THE SAME, AND ASSOCIATED METHODS

(75) Inventors: Sang Hee Park, Uiwang-si (KR); Deok Young Choi, Uiwang-si (KR); Byung Cheol Lee, Uiwang-si (KR); Hee In Nam, Uiwang-si (KR); Hyun Don Kim, Uiwang-si (KR)

(73) Assignee: Cheil Industries, Inc., Gumi-si, Kyeongsanbuk-do (KR)

( * ) Notice: Subject to any disclaimer, the term of this patent is extended or adjusted under 35 U.S.C. 154(b) by 501 days.

(21) Appl. No.: 12/453,891

(22) Filed: May 26, 2009

(65) Prior Publication Data

US 2009/0295267 A1 Dec. 3, 2009

Related U.S. Application Data

(63) Continuation of application No. PCT/KR2006/005410, filed on Dec. 12, 2006.

(30) Foreign Application Priority Data

Nov. 24, 2006 (KR) ..... 10-2006-0117116

(51) Int. Cl.
*H01J 17/49* (2012.01)

(52) U.S. Cl. ..... 313/582; 313/491; 313/503; 252/512; 252/514; 445/24

(58) Field of Classification Search ..... 313/582–587, 313/491, 503; 252/512–514; 445/24
See application file for complete search history.

(56) References Cited

U.S. PATENT DOCUMENTS

| | | | | |
|---|---|---|---|---|
| 6,632,524 | B1 * | 10/2003 | Toshima et al. | 428/357 |
| 6,866,800 | B2 | 3/2005 | Adachi | |
| 6,893,490 | B2 * | 5/2005 | Kawamura et al. | 106/31.64 |
| 2005/0279970 | A1 * | 12/2005 | Ogi et al. | 252/514 |
| 2006/0181211 | A1 * | 8/2006 | Terao et al. | 313/582 |
| 2008/0272684 | A1 * | 11/2008 | Horikawa et al. | 313/492 |

FOREIGN PATENT DOCUMENTS

| | | | |
|---|---|---|---|
| JP | 11-120906 | A | 4/1999 |
| JP | 2003-323815 | A | 11/2003 |
| KR | 10-2003-0079566 | A | 10/2003 |
| KR | 10-2005-0087113 | A | 8/2005 |

* cited by examiner

*Primary Examiner* — Karabi Guharay
*Assistant Examiner* — Kevin Quarterman
(74) *Attorney, Agent, or Firm* — Lee & Morse, P.C.

(57) ABSTRACT

A paste composition for forming an electrode includes: Component A: a conductive powder; Component B: a glass frit having a transmittance of about 65% or less at a wavelength of 550 nm; Component C: an organic binder; and Component D: a solvent.

20 Claims, 2 Drawing Sheets

| | Ag powder (g) | Glass frit (g) | Black pigment (g) | Organic binder (g) | Functional monomer (g) | Photo-polymerization initiator (g) | Solvent (g) | Specific resistance (μΩ·cm) | Blackness degree (L*) | Reflected luminance (cd/m²) |
|---|---|---|---|---|---|---|---|---|---|---|
| Ex. 1 | 60 | 8 (1) | 3 | 6.5 | 4.5 | 2 | 16 | 3.5 | 32 | 9.1 |
| Ex. 2 | 60 | 8 (2) | 3 | 6.5 | 4.5 | 2 | 16 | 3.7 | 35 | 10.2 |
| Ex. 3 | 60 | 8 (3) | 3 | 6.5 | 4.5 | 2 | 16 | 3.6 | 37 | 10.8 |
| Ex. 4 | 60 | 8 (4) | - | 6.5 | 4.5 | 2 | 16 | 3.0 | 40 | 11.4 |
| Comp. Ex. 1 | 60 | 8 (5) | 3 | 6.5 | 4.5 | 2 | 16 | 3.8 | 61 | 16.7 |
| Comp. Ex. 2 | 50 | 8 (6) | 13 | 6.5 | 4.5 | 2 | 16 | 7.9 | 37 | 10.7 |

Notes regarding glass frit:
1 BT328® ..... transmittance: 8.8%, crystallinity: 28.2%.
2 BT2607J® ..... transmittance: 12.7%, crystallinity: 27.5%.
3 KF1163® ..... transmittance: 20.6%, crystallinity: 20.7%.
4 CG001E-55C-2® .... transmittance: 10.5%, crystallinity: 35%.
5 FLE-401® ..... transmittance: 89.1%, crystallinity: 0%.
6 BT328®, ..... (see note 1 for transmittance and crystallinity values).

FIG. 2

| | Ag powder (g) | Glass frit (g) | Black pigment (g) | Organic binder (g) | Functional monomer (g) | Photo-polymerization initiator (g) | Solvent (g) | Specific resistance (μΩ·cm) | Blackness degree (L*) | Reflected luminance (cd/m$^2$) |
|---|---|---|---|---|---|---|---|---|---|---|
| Ex. 1 | 60 | 8 (1) | 3 | 6.5 | 4.5 | 2 | 16 | 3.5 | 32 | 9.1 |
| Ex. 2 | 60 | 8 (2) | 3 | 6.5 | 4.5 | 2 | 16 | 3.7 | 35 | 10.2 |
| Ex. 3 | 60 | 8 (3) | 3 | 6.5 | 4.5 | 2 | 16 | 3.6 | 37 | 10.8 |
| Ex. 4 | 60 | 8 (4) | - | 6.5 | 4.5 | 2 | 16 | 3.0 | 40 | 11.4 |
| Comp. Ex. 1 | 60 | 8 (5) | 3 | 6.5 | 4.5 | 2 | 16 | 3.8 | 61 | 16.7 |
| Comp. Ex. 2 | 50 | 8 (6) | 13 | 6.5 | 4.5 | 2 | 16 | 7.9 | 37 | 10.7 |

Notes regarding glass frit:

1 BT328® ..... transmittance: 8.8%, crystallinity: 28.2%.
2 BT26071® ..... transmittance: 12.7%, crystallinity: 27.5%.
3 KFI163® ..... transmittance: 20.6%, crystallinity: 20.7%.
4 CG001E-55C-2® .... transmittance: 10.5%, crystallinity: 35%.
5 FLE-401®, ..... transmittance: 89.1%, crystallinity: 0%.
6 BT328®, ..... (see note 1 for transmittance and crystallinity values).

PASTE COMPOSITION FOR FABRICATING ELECTRODE, ELECTRODE AND PLASMA DISPLAY PANEL FORMED USING THE SAME, AND ASSOCIATED METHODS

CROSS-REFERENCE TO RELATED APPLICATION

The present application is a continuation application of co-pending PCT Patent Application Serial No. PCT/KR2006/005410, entitled, "Composition of Paste for Fabricating Electrode and Plasma Display Panel Including the Electrode," which was filed on Dec. 12, 2006, and is incorporated by reference herein in its entirety.

BACKGROUND

1. Field

Embodiments relate to a paste composition for fabricating an electrode, an electrode and a plasma display panel formed using the same, and associated methods.

2. Description of the Related Art

Generally, plasma display panels (referred to as "PDPs") are electric display devices in which an inert gas, e.g., a mix of neon (Ne) and argon (Ar), or a mix of neon (Ne) and xenon (Xe), is injected into spaces defined by a front substrate, a rear substrate and a partition between the two substrates. A voltage applied to electrodes arranged at a discharge cell between the two substrates results in plasma discharge that stimulate an emissive material, e.g., a phosphor, to display visible light.

A PDP may be used in high definition televisions (HDTVs) owing to its advantages of very strong nonlinearity of an applied voltage, long life time, high luminance, high light-emitting efficiency, wide viewing angle, and large screen size.

The PDP may include a front glass substrate and a rear glass substrate. The front glass substrate may include a transparent electrode and a bus electrode thereon. A pair of such electrodes may be used to form discharge sustain electrodes extending in parallel directions.

The sustain electrodes may be coated with a transparent dielectric layer, preferably, a transparent protective layer. A plurality of address electrodes may be arranged on the rear glass substrate, perpendicularly crossing the discharge sustain electrodes and coated in the similar manner as in the coating of the front glass substrate electrodes.

Discharge cells, e.g., pixels, may be defined by barrier ribs at the intersections of the discharge sustain electrodes and the address electrodes, or adjacent regions thereof. Each discharge cell may be selectively discharged to emit visible light, thereby displaying an image.

SUMMARY

Embodiments are directed to a paste composition for fabricating an electrode, an electrode and a plasma display panel formed using the same, and associated methods, which substantially overcome one or more of the problems due to the limitations and disadvantages of the related art.

It is therefore a feature of an embodiment to provide a paste composition for fabricating an electrode, an electrode and a plasma display panel formed using the same, and associated methods, in which an electrode has a high degree of blackness and a low resistance.

It is therefore another feature of an embodiment to provide a paste composition for fabricating an electrode, an electrode and a plasma display panel formed using the same, and associated methods, in which an electrode has a high degree of blackness and a low resistance while being formed as a single, monolithic structure.

It is therefore another feature of an embodiment to provide a paste composition for fabricating an electrode, an electrode and a plasma display panel formed using the same, and associated methods, in which an electrode has a high degree of blackness and a low resistance while being formed as a single, monolithic structure, and which may be combined with an adjacent transparent electrode layer to form a display electrode.

At least one of the above and other features and advantages may be realized by providing a paste composition for forming an electrode, the paste composition including Component A: a conductive powder; Component B: a glass frit having a transmittance of about 65% or less at a wavelength of 550 nm; Component C: an organic binder; and Component D: a solvent.

The paste composition may include about 30% to about 90% by weight of Component A, about 1% to about 20% by weight of Component B, about 1% to about 20% by weight of Component C, and about 1% to about 68% by weight of Component D.

The conductive powder may be a metal powder or metal alloy powder made from at least one of gold, silver, copper, nickel, palladium, platinum, or aluminum.

The paste composition may further include Component E: a black pigment. The paste composition may include about 1% to about 20% by weight of Component E.

The black pigment may include at least one metal oxide, and the at least one metal oxide may include iron, cobalt, chromium, manganese, aluminum, zinc, or nickel.

The glass frit may have a crystallinity of about 5% to about 80%.

The glass frit may have a crystallinity of about 5% to about 30%.

The glass frit has a crystallizing temperature of about 400° C. to about 700° C.

The glass frit may have a softening temperature of about 300° C. to about 500° C.

The glass frit may be a colored glass frit having color provided by a colorant, and the colorant may include at least one of iron, cobalt, chromium, manganese, aluminum, zinc, or nickel.

The organic binder may include at least one of an acrylic polymer and a cellulose polymer.

The paste composition may further include a photo polymerization compound, and a photo polymerization initiator. The paste composition may include about 1% to about 20% by weight of the photo polymerization compound, and about 1% to about 15% by weight of the photo polymerization initiator.

The paste composition may further include at least one of a UV stabilizer, a viscosity stabilizer, an anti-foaming agent, a dispersing agent, a leveling agent, an antioxidant, and a thermal polymerization inhibitor.

The weight percentage of Component A, determined based on the entire weight of the composition, may be sufficient to provide the electrode with a specific resistance of about 6 μΩ·cm or less.

At least one of the above and other features and advantages may also be realized by providing an electrode manufactured by screen printing, offset printing, or photolithography using the paste composition according to an embodiment.

At least one of the above and other features and advantages may also be realized by providing a plasma display panel including an electrode manufactured using the paste composition according to an embodiment.

The electrode may be a single-layer bus electrode, and the bus electrode may be on a transparent electrode.

The plasma display panel may include an address electrode used to initiate a plasma discharge, the plasma display panel may include a bus electrode forming all or part of a display electrode used to maintain the plasma discharge, and the address electrode and the bus electrode may each be manufactured using the paste composition according to an embodiment.

At least one of the above and other features and advantages may also be realized by providing a method of fabricating a plasma display device, the method including forming a first electrode at a surface of a first substrate, forming a second electrode at a surface of a second substrate, defining a discharge cell between the first and second substrates, and fixing the first substrate to the second substrate such that the first and second electrodes are proximate to each other at the discharge cell. At least one of the first electrode and the second electrode may be formed using a paste composition that includes: Component A: a conductive powder; Component B: a glass frit having a transmittance of 65% or less at a wavelength of 550 nm; Component C: an organic binder; and Component D: a solvent.

The weight percentage of Component A, determined based on the entire weight of the composition, may be sufficient to provide the at least one of the first electrode and the second electrode with a specific resistance of about 6 μΩ·cm or less.

BRIEF DESCRIPTION OF THE DRAWINGS

The above and other features and advantages will become more apparent to those of skill in the art by describing in detail example embodiments with reference to the attached drawings, in which:

FIG. 2 illustrates components and figures of merit for paste compositions and resultant electrodes.

DETAILED DESCRIPTION

Figure 1:
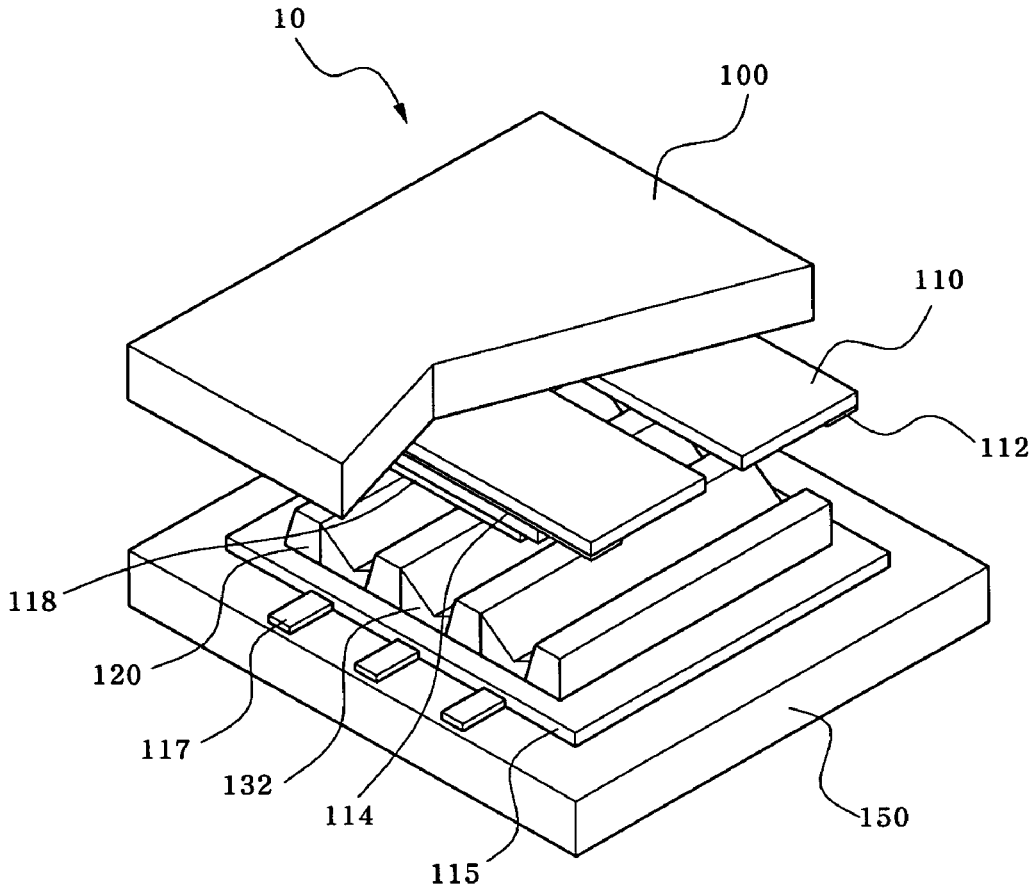
FIG. 1 illustrates an exploded perspective view of a plasma display panel according to an embodiment.

Korean Patent Application No. 10-2006-0117116, filed on Nov. 24, 2006, in the Korean Intellectual Property Office, and entitled: "Composition of Paste for Fabricating Electrode and Plasma Display Panel Including the Electrode," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of." For example, the expression "at least one of A, B, and C" may also include an nth member, where n is greater than 3, whereas the expression "at least one selected from the group consisting of A, B, and C" does not.

As used herein, the expression "or" is not an "exclusive or" unless it is used in conjunction with the term "either." For example, the expression "A, B, or C" includes A alone; B alone; C alone; both A and B together; both A and C together; both B and C together; and all three of A, B, and C together, whereas the expression "either A, B, or C" means one of A alone, B alone, and C alone, and does not mean any of both A and B together; both A and C together; both B and C together; and all three of A, B, and C together.

As used herein, the terms "a" and "an" are open terms that may be used in conjunction with singular items or with plural items. For example, the term "a metal oxide" may represent a single compound, e.g., aluminum oxide, or multiple compounds in combination, e.g., aluminum oxide mixed with cobalt oxide.

An embodiment relates to a paste composition for forming an electrode, e.g., a bus electrode or address electrode, in a plasma display panel. Another embodiment relates to a plasma display panel including an electrode manufactured by using the paste composition.

In an implementation, the paste composition for forming an electrode may include a conductive powder, a glass frit, an organic binder, and a solvent. The glass frit may have a transmittance of about 65%, or less, as determined at a wavelength of 550 nm.

An electrode may be manufactured with the paste composition by, e.g., screen printing, offset printing, or photolithography. A plasma display panel may be formed using the electrode as, e.g., a bus electrode that corresponds to a transparent electrode, the bus electrode and the transparent electrode acting together as a display electrode. In another implementation, the electrode may be an address electrode, which may be monolithic and formed as a single layer.

As described above, the paste composition for forming an electrode according to an embodiment may include the conductive powder, the glass frit, the organic binder, and the solvent.

The conductive powder may be, e.g., a conductive inorganic material or a conductive organic material. Preferably, the conductive powder is capable of withstanding high temperatures, e.g., about 500° C. to about 600° C.

Preferably, the conductive powder includes, e.g., gold (Au), silver (Ag), copper (Cu), nickel (Ni), palladium (Pd), platinum (Pt), aluminum (Al), or an alloy thereof.

Depending on the thickness of the electrode film formed with the composition, it may be preferable to use as the conductive powder a metal powder having a median diameter ($d_{50}$) of about 3 μm or less. Preferably, the amount of the conductive material is about 30% to about 90% by weight, more preferably about 50% to about 80% by weight, based on the weight of the paste composition.

The use of an amount of the conductive material that is lower than about 30 wt % of the paste composition may cause an increased resistance in the resultant electrode, and thus may cause an elevated discharge voltage that can reduce luminance in a PDP having the electrode. The use of an amount of the conductive material that is more than about 90 wt % of the paste composition may result in the composition containing relatively small amounts of the glass frit and the organic binder, which may make the composition difficult to paste and may reduce adhesion to a glass substrate.

The glass frit used in the paste composition according to an embodiment is preferably a crystallized glass frit having a softening temperature of about 300° C. to about 500° C. and a transmittance of about 65% or less as determined at a wavelength of 550 nm. A crystallized glass frit having a transmittance exceeding about 65% may not sufficiently control the transmittance and, as such, may not provide a sufficiently high degree of blackness (i.e., a sufficiently low L*).

Preferably, the glass frit has a crystallinity of about 5% to about 80% at a temperature of 400° C. to 700° C. Crystallized glass frit having a crystallinity lower than about 5% may have a high transmittance, which may reduce the degree of blackness (i.e., increase L* values) and undesirably increase the reflected luminance of external light. The use of crystallized glass frit having a crystallinity greater than about 80% may also cause cracks therein after agglomeration.

Preferably, the amount of the crystallized glass frit in the paste composition is about 1% to about 20% by weight, more preferably about 3% to about 15% by weight. The use of an amount of crystallized glass frit that is lower than about 1 wt % may reduce adhesion between conductive material in the paste composition and a glass substrate. The use of an amount of crystallized glass frit that is more than about 20 wt % may cause excessive glass frit residues after baking, which may lead to an undesirable increase in resistance.

In an implementation, the crystallized glass frit may be black-colored glass frit. The black-colored glass frit may include a colorant that provides the black color. The colorant may include one or more of iron (Fe), cobalt (Co), chromium (Cr), manganese (Mn), aluminum (Al), zinc (Zn), or nickel (Ni). The use of the black-colored glass frit may help provide a desired degree of blackness without using any black pigment in the paste composition.

The organic binder in the paste composition may serve to evenly bind the other components of the composition, e.g., the conductive material and the crystallized glass frit, during formation of the electrode, and to maintain the adhesion of the conductive material to the glass substrate after printing and drying, and prior to baking.

The organic binder may include, e.g., an acrylic or cellulose polymer. In an implementation, the organic binder may include an acrylic copolymer of an acrylic monomer containing a hydrophilic group (e.g., carboxyl), which may provide solubility in an alkaline developer when using a photosensitive paste composition. In an implementation, the organic binder may include a cellulose polymer such as a polymer formed using ethyl cellulose, hydroxyethyl cellulose, hydroxypropyl cellulose, or hydroxyethyl hydroxypropyl cellulose.

Preferably, the amount of the organic binder in the paste composition is about 1% to about 20% by weight, more preferably about 4% to about 15% by weight. If the organic binder is used in an amount lower than 1 wt %, the paste composition may exhibit a significantly reduced viscosity after formation, and/or exhibit deteriorated adhesion to the glass substrate after printing and drying. If the organic binder is used in an amount exceeding about 20 wt %, it may not be completely decomposed during baking due to the large amount, thus leading to an increase in resistance in the resultant electrode.

A solvent with a boiling point 120° C. or above may be used in the paste composition. Examples of the solvent include methyl cellosolve, ethyl cellosolve, butyl cellosolve, aliphatic alcohol, α-terpineol, β-terpineol, dihydroterpineol, ethylene glycol, ethylene glycol monobutyl ether, butyl cellosolve acetate, and texanol. The solvent may be used alone or as a mixture of two or more kinds thereof.

The solvent may be used in the paste composition in an amount of about 1% to about 68% by weight, although it will be appreciated that the amount of solvent may be adjusted depending on specific conditions. The amount of solvent may be varied so as to adjust the viscosity of the composition to a desired level.

In an embodiment, the composition may further include a black pigment to improve the degree of blackness of the electrode. The black pigment may include, e.g., a metal oxide. The metal oxide may include an oxide of, e.g., iron (Fe), cobalt (Co), chromium (Cr), manganese (Mn), aluminum (Al), zinc (Zn), or nickel (Ni), or a combination thereof. Considering the degree of blackness and resistance of the electrode, the black pigment is preferably used in the paste composition in an amount of about 1% to about 20% by weight, based on the entire weight of the composition. In this regard, the use of less than about 1% by weight of the black pigment may produce little effect on the degree of blackness, whereas the use of more than about 20% by weight may result in an increase in resistance of the resultant electrode, e.g., because of poor conductivity of the black pigment and/or as a result of a corresponding reduction in the amount of conductive material included in the paste composition.

In an implementation, the weight percentage of the conductive powder in the composition, determined based on the entire weight of the composition, is sufficient to provide the electrode with a specific resistance of about 6 μΩ·cm or less. Reducing the amount of black pigment, or omitting the black pigment entirely, may allow for a correspondingly greater amount of conductive powder to be included in the composition. Similarly, using a glass frit with a low transmittance, e.g., about 65% or less, and/or using a glass frit having a colorant, may lower the overall reflectivity of an electrode produced using the composition and, thus, may enable the amount of black pigment in the composition to be reduced while the amount of conductive powder is correspondingly increased.

The paste composition may further include one or more additives. The additive(s) may include, e.g., a UV stabilizer, a viscosity stabilizer, an anti-foaming agent, a dispersing agent, a leveling agent, an antioxidant, or a thermal polymerization inhibitor.

The paste composition may be used to manufacture an electrode in a process such as screen printing, offset printing, or photolithography.

In the case of forming an electrode by photolithography, the paste composition may be photosensitive and may include a photo polymerization compound and a photo polymerization initiator.

The photo polymerization compound may be a polyfunctional monomer or oligomer used in a photosensitive resin composition. For example, the photo polymerization compound may include ethylene glycol diacrylate, triethylene glycol diacrylate, 1,4-butanediol diacrylate, 1,6-hexanediol diacrylate, neopentyl glycol diacrylate, pentaerythritol diacrylate, pentaerythritol triacrylate, dipentaerythritol diacrylate, dipentaerythritol triacrylate, dipentaerythritol pentaacrylate, pentaerythritol hexaacrylate, bisphenol-A diacrylate, trimethylolpropane triacrylate, novolac epoxy acrylate, ethylene glycol dimethacrylate, diethylene glycol dimethacrylate, triethylene glycol dimethacrylate, propylene glycol dimethacrylate, 1,4-butanediol dimethacrylate, or 1,6-hexanediol dimethacrylate.

When used, the photo polymerization compound is preferably used in the paste composition in an amount of about 1% to about 20% by weight. The use of less than about 1% by weight may produce insufficient photocuring of the composition, which may result in pattern loss during development. The use of more than about 20% by weight may require a large amount of polyfunctional monomer or oligomer, which may result in an increase in the resistance of the resultant electrode if the organic compounds are not completely decomposed during baking/firing of the electrode.

A photo polymerization initiator that exhibits good photoreactivity at a UV wavelength of 200 nm to 400 nm may be used for a photosensitive paste composition. The photo polymerization initiator may include, e.g., a benzophenone, an acetophenone, or a triazine.

When used, the photo polymerization initiator is preferably used in the paste composition in an amount of about 1% to about 15% by weight.

FIG. 1 illustrates an exploded perspective view of a plasma display panel according to an embodiment.

Referring to FIG. 1, the plasma display panel 10 may include a front substrate 100 and a rear substrate 150.

The front substrate 100 and the rear substrate 150 may be arranged to face each other. A pair of transparent electrodes 110 may be arranged to extend in a first direction, e.g., a horizontal direction, at a surface of the front substrate 100. A bus electrode 112 may be formed on each transparent electrode 110. A first dielectric layer 114 and a magnesium oxide (MgO) layer 118 may be formed on each transparent electrode 110. The first dielectric layer 114 may store an electric charge created inside the plasma display panel during operation thereof. The MgO layer 118 may cover the first dielectric layer 114 and may produce secondary electron emission.

A plurality of address electrodes 117 may be arranged in a second direction that crosses the first direction at a surface of the rear substrate 150. A second dielectric layer 115 may be formed on the rear substrate 150. Barrier ribs 120, in which R, G, and B fluorescence materials, e.g., phosphors, 132 may be respectively positioned, may be arranged on the second dielectric layer 115. The barrier ribs 120 may define pixel regions.

An inert gas, e.g., a mixed inert gas of Ne and Ar, or mixed Ne and Xe, may be injected into a space between the front substrate 100 and the rear substrate 150. When a voltage of a critical level or above is applied to the electrodes, a plasma may be generated in the inert gas, thus stimulating the phosphors to emit visible light.

In the PDP 10, the bus electrode 112 and/or the address electrode 117 may be formed using the paste composition according to an embodiment. Electrode formation may be carried out using, e.g., screen printing, offset printing, or photolithography.

An example method for forming an electrode by photolithography may include the following:

applying a photosensitive paste composition according to an embodiment to a glass substrate, e.g., so as to form a paste with a thickness of about 5 μm to about 40 μm, to form a photoresist film;

drying the photoresist film, e.g., at a temperature of 80° C. to 150° C. for about 20 to about 60 min;

exposing the photoresist film to UV radiation through a photomask;

developing the exposed photoresist film to remove a portion thereof, e.g., to remove an exposed region or a non-exposed region; and after developing, then drying and baking the remaining region of the photoresist film, e.g., at a temperature of about 500° C. to 600° C.

An electrode manufactured with the paste composition according to an embodiment may exhibit low specific resistance, a high degree of blackness, and low reflectance of external light. The following Examples and Comparative Examples are provided in order to set forth particular details of one or more embodiments. However, it will be understood that the embodiments are not limited to the particular details described. Further, where not specifically mentioned herein, it will be apparent to those skilled in the art that detailed contents can be derived from the following description. Accordingly, the disclosure thereof may be omitted.

1. EXAMPLES AND COMPARATIVE EXAMPLES

Example 1

60 g of an Ag power (average diameter: 1.5 μm, AG-2-11® available from Dowa Hightech Co., Ltd.) was used as a conductive powder. 8 g of crystallized glass frit (transmittance at a wavelength of 550 nm: 8.8%, crystallinity: 28.2%, BT328® available from Yamamura Glass Co., Ltd.) was used. 6.5 g of polymethyl methacrylate-co-methacrylic acid (P 118®, Japan) was used as an acrylic copolymer organic binder.

3 g of cobalt oxide ($Co_2O_3$) (CX-100® available from Mitsui Mining Co., Ltd.) was added thereto as a black pigment. 4.5 g of a functional monomer (trimethylolpropane ethoxy triacrylate available from Miwon Commercial Co., Ltd.) was added thereto as a photo polymerization compound. 2 g of 2-methyl-4'-methylthio-2-morpholino-propiophenone (available from SARTOMER Co., Ltd.) was added thereto as a photo polymerization initiator. 16 g of texanol (available from Eastman Chemical Co., Ltd.) was added thereto as a solvent.

The components forming the paste composition of Example 1 were sufficiently dispersed with a 3 roll mill to prepare the paste composition.

Example 2

A paste composition was prepared in the same manner as in Example 1, except: crystallized glass frit having a transmittance of 12.7% at a wavelength of 550 nm and crystallinity of 27.5% (BT26071® available from Yamamura Glass Co., Ltd.) was used instead of BT328®.

Example 3

A paste composition was prepared in the same manner as in Example 1, except: crystallized glass frit having a transmittance of 20.6% at a wavelength of 550 nm and crystallinity of 20.7% (KFI163® available from Asahi Techno Glass Corp.) was used instead of BT328®.

Example 4

A paste composition was prepared in the same manner as in Example 1, except: colored crystallized glass frit having a transmittance of 10.5% at a wavelength of 550 nm (CG001E-55C-2® available from Phoenix PDE Co., Ltd., Korea) was used instead of BT328®, and no black pigment was used.

Comparative Example 1

A paste composition was prepared in the same manner as in Example 1, except: amorphous glass frit having a transmittance of 89.1% at a wavelength of 550 nm and crystallinity of 0% (FLE-401® available from NHY Corp., Japan) was used instead of BT328®.

Comparative Example 2

A paste composition was prepared in the same manner as in Example 1, except: the Ag power was used in an amount of 50 g instead of 60 g, and the black pigment was used in an amount of 13 g instead of 3 g.

The above-described constituents of each composition prepared in Examples 1 to 4 and Comparative Examples 1 to 2 are shown in FIG. 2.

2. EVALUATION OF PHYSICAL PROPERTIES

Respective electrode patterns were formed by using the compounds prepared in Examples 1 to 4 and Comparative Examples 1 and 2. The electrode patterns were evaluated for specific resistance, degree of blackness, and reflected luminance of external light. The results are shown in FIG. 2.

(1) Measurement of Specific Resistance

The resistance of the formed electrode pattern was measured with a line resistance meter (2000 Multimeter® available from Keithley Instruments, Inc.). Then, the line width and thickness of the electrode pattern were measured with a profiler (P-10®, Tencor Instruments Co.).

After the data measurement, a specific resistance was obtained using Equation 1 below:

$$\text{Specific resistance } (\mu\Omega\cdot\text{cm}) = \text{line resistance } (\mu\Omega) \times \text{thickness (cm)} \times \text{width (cm)}/\text{length (cm)} \quad \text{Equation 1}$$

As the specific resistance of the electrode decreases, the line resistance of the panel tends to decrease, which may lead to an advantageous reduction in discharge voltage and improvement in brightness of a displayed image.

(2) Measurement of Degree of Blackness (L*)

The composition of the present invention was printed on a glass substrate by screen printing. The resulting substrate was subjected to drying and baking to prepare a sample. The degree of blackness (L*) of the sample was measured with a colormeter (CM-508i®, Minolta Co., Ltd.).

Herein, the degree of blackness (L*) is understood to be a measure of luminance according to the CIE "Lab" model (L*a*b), in which a lower degree of blackness indicates a deeper blackness and a higher degree of blackness indicates a more luminous appearance. In the case of forming an electrode for a PDP, it is preferred that the degree of blackness be as low as possible because a lower degree of blackness (i.e., a smaller L* value) is indicative of a lessening of reflected luminance of external light in the finished PDP panel.

(3) Determination of Reflected Luminance of External Light

The degree of blackness (L*) of the formed electrode pattern was measured with a colormeter (CM-508i®, Minolta Co., Ltd.). Then, the line width of the electrode pattern was measured with a profiler (P-10®, Tencor Instruments Co.). After the measurements, a value for reflected luminance of an external light was obtained by calculating a ratio of a black area to the line width and multiplying the ratio to the measured degree of blackness. The reflected luminance may be a significant factor in determining the contrast ratio of PDP panels, where a lower level of reflected luminance indicates a better (higher) contrast ration in the PDP.

3. RESULTS

As can be seen from FIG. 2, in Examples 1 to 4, the use of the crystallized glass frit having a low transmittance ensured a high degree of blackness, i.e., a low L* value, and allowed for a low specific resistance.

In particular, in the case of Example 4 using a composition containing colored-crystallized glass frit, a desirable blackness could be obtained without using any black pigment. Avoiding the use of black pigment may help ensure a low specific resistance, particularly where the black pigment is non-conductive or poorly conductive, and/or where the absence of black pigment allows for a corresponding increase in the amount of conductive material.

On the other hand, the use of amorphous glass frit having a high transmittance in Comparative Example 1 resulted in a specific resistance comparable to those of Examples but showed poor blackness, i.e., high L*, such that an electrode would exhibit an increase in the reflected luminance of external light.

In the case of Comparative Example 2, in which the electrode was manufactured by using the composition containing a relatively small amount of the Ag powder and a relatively large amount of the black pigment to improve the degree of blackness, the electrode exhibited a degree of blackness comparable to those of the Examples, but also showed a doubling in the specific resistance as compared to the Examples, such that a PDP including the electrode may exhibit an increase in discharge voltage.

As described herein, a paste composition for forming an electrode according to an embodiment may enable realization of an electrode exhibiting a superior degree of blackness and low reflected luminance of external light. The paste composition for forming an electrode according to an embodiment may reduce or eliminate the need for the inclusion of black pigment, and may thus provide an electrode showing superior electric conductivity. As a result, a plasma display panel according to an embodiment, e.g., using address and/or display electrodes formed using the paste composition, may exhibit reduced discharge voltage and a corresponding improvement in the luminance of the displayed image. The paste composition according to an embodiment may be used to form metal electrodes for a PDP that are superior to metal electrodes formed using a plain silver (Ag) paste.

In the design of a PDP, a transparent electrode may be formed on the front substrate (which may be a glass substrate transmitting an image to a viewer). The transparent electrode may be formed of indium tin oxide (ITO), which has a relatively large resistance per unit area. Accordingly, a bus electrode having relatively higher conductivity may be formed on the transparent electrode using the paste composition according to an embodiment, where the bus electrode and the transparent electrode form a multilayer structure with a high overall conductivity. As the bus electrode may block light, it may cause a reduction in luminance of an image displayed by the PDP. Thus, to avoid unduly restricting the aperture through which visible light is emitted, it is preferable that the width of bus electrode be as small as possible while providing a desired line resistance, i.e., a low resistance.

Generally, a bus electrode for a PDP may be formed to have a triple layer structure, e.g., a Cr/Cu/Cr structure formed by vapor deposition and etching, or a double layer structure, e.g., a black layer (which may be non-conductive) and a conductive layer formed by printing or photolithography. However, the Cr/Cu/Cr triple layer formed by vapor deposition and etching involves disadvantageously long process times, high costs for thin-film forming equipment and materials, and environment contamination due to etching. Further, the double layer formed by photolithography involves disadvantageous repetitions of two or more cycles of printing and drying due to the two layers introduced, and electrode defects resulting from non-uniformity of the two layers.

In contrast, the paste composition according to an embodiment may be used to form an integrated structure, i.e., a single layer having the two characteristics of the black and conductive layers, which may be implemented as a bus electrode. The single layer bus electrode formed according to an embodiment may provide all of the characteristics of the black and conductive layers, i.e., it may provide a low resistance and a high degree of blackness (i.e., a low L* value) so as to minimize the reflected luminance of external light.

The paste composition according to an embodiment may be used to form, e.g., address electrodes in a predetermined pattern on a substrate of a PDP, or a relatively highly-conductive bus electrode on a transparent electrode, the bus and transparent electrodes forming a display electrode of a PDP, e.g., a sustain and/or a scan electrode. The paste composition according to an embodiment may include a resin acting as an organic binder, a conductive material, a glass frit, a black pigment, a solvent, other additives, etc. After baking the composition, the conductive metal, the black pigment, and the glass frit may remain (the other components being evaporated and/or decomposed) to form a predetermined pattern. The materials forming the glass frit and the black pigment may have a relatively high resistance, thus tending to increase electrode resistance. Accordingly, it may be preferable to minimize the use thereof, and/or use glass frit that produces a high degree of blackness.

A bus electrode with an integrated, i.e., monolithic, structure of a single layer may be formed using the paste composition according to an embodiment, and may provide advantages such as a simplified fabrication procedure for the resultant electrode and reduced material costs. Further, an electrode formed using the paste composition according to an embodiment may provide a low resistance by enabling a reduction or elimination of the use of the black pigment having a high resistance. Additionally, an electrode formed using the paste composition according to an embodiment may provide a high degree of blackness (i.e., low L* value) while allowing the proportion of conductive metal to be increased relative to that of the black pigment.

Example embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A paste composition for forming an electrode, the paste composition comprising:

Component A: a conductive powder;

Component B: a glass frit having a transmittance of about 65% or less at a wavelength of 550 nm;

Component C: an organic binder; and

Component D: a solvent.

2. The paste composition as claimed in claim 1, wherein the paste composition includes:

about 30% to about 90% by weight of Component A, about 1% to about 20% by weight of Component B, about 1% to about 20% by weight of Component C, and about 1% to about 68% by weight of Component D.

3. The paste composition as claimed in claim 1, wherein the conductive powder is a metal powder or metal alloy powder made from at least one of gold, silver, copper, nickel, palladium, platinum, or aluminum.

4. The paste composition as claimed in claim 1, further comprising:

Component E: a black pigment, wherein:

the paste composition includes about 1% to about 20% by weight of Component E.

5. The paste composition as claimed in claim 4, wherein:

the black pigment includes at least one metal oxide, and the at least one metal oxide includes iron, cobalt, chromium, manganese, aluminum, zinc, or nickel.

6. The paste composition as claimed in claim 1, wherein the glass fit has a crystallinity of about 5% to about 80%.

7. The paste composition as claimed in claim 6, wherein the glass fit has a crystallinity of about 5% to about 30%.

8. The paste composition as claimed in claim 6, wherein the glass frit has a crystallizing temperature of about 400° C. to about 700° C.

9. The paste composition as claimed in claim 1, wherein the glass fit has a softening temperature of about 300° C. to about 500° C.

10. The paste composition as claimed in claim 1, wherein:

the glass frit is a colored glass frit having color provided by a colorant, and the colorant includes at least one of iron, cobalt, chromium, manganese, aluminum, zinc, or nickel.

11. The paste composition as claimed in claim 1, wherein the organic binder includes at least one of an acrylic polymer and a cellulose polymer.

12. The paste composition as claimed in claim 1, further comprising:

a photo polymerization compound; and a photo polymerization initiator, wherein the paste composition includes:

about 1% to about 20% by weight of the photo polymerization compound, and about 1% to about 15% by weight of the photo polymerization initiator.

13. The paste composition as claimed in claim 1, further comprising at least one of a UV stabilizer, a viscosity stabilizer, an anti-foaming agent, a dispersing agent, a leveling agent, an antioxidant, and a thermal polymerization inhibitor.

14. The paste composition as claimed in claim 1, wherein the weight percentage of Component A, determined based on the entire weight of the composition, is sufficient to provide the electrode with a specific resistance of about 6 μΩ·cm or less.

15. An electrode manufactured by screen printing, offset printing, or photolithography using the paste composition as claimed in claim 1.

16. A plasma display panel including an electrode manufactured using the paste composition as claimed in claim 1.

17. The plasma display panel as claimed in claim 16, wherein:

the electrode is a single-layer bus electrode, and the bus electrode is on a transparent electrode.

18. The plasma display panel as claimed in claim 16, wherein:

the plasma display panel includes an address electrode used to initiate a plasma discharge, the plasma display panel includes a bus electrode forming all or part of a display electrode used to maintain the plasma discharge, and the address electrode and the bus electrode are each manufactured using the paste composition as claimed in claim 1.

19. A method of fabricating a plasma display device, the method comprising:

forming a first electrode at a surface of a first substrate;

forming a second electrode at a surface of a second substrate;

defining a discharge cell between the first and second substrates; and fixing the first substrate to the second substrate such that the first and second electrodes are proximate to each other at the discharge cell, wherein:

at least one of the first electrode and the second electrode is formed using a paste composition that includes:

Component A: a conductive powder;

Component B: a glass fit having a transmittance of 65% or less at a wavelength of 550 nm;

Component C: an organic binder; and

Component D: a solvent.

20. The method as claimed in claim 19, wherein the weight percentage of Component A, determined based on the entire weight of the composition, is sufficient to provide the at least one of the first electrode and the second electrode with a specific resistance of about 6 μΩ·cm or less.

* * * * *